US009297163B2

(12) United States Patent
Golledge et al.

(10) Patent No.: US 9,297,163 B2
(45) Date of Patent: Mar. 29, 2016

(54) DUAL MESH LEVEL REINFORCEMENT BAR SUPPORT CHAIR ASSEMBLY

(71) Applicant: BFRE Pty Ltd., Bowral, New South Wales (AU)

(72) Inventors: Malcolm Alexander Golledge, Bowral (AU); Lyndon Alexander Golledge, Bowral (AU); Brad Frank Golledge, Bowral (AU)

(73) Assignee: BFRE PTY Ltd., Bowral, New South Wales (AU)

( * ) Notice: Subject to any disclaimer, the term of this patent is extended or adjusted under 35 U.S.C. 154(b) by 0 days.

(21) Appl. No.: 14/486,979

(22) Filed: Sep. 15, 2014

(65) Prior Publication Data

US 2015/0075110 A1 Mar. 19, 2015

(51) Int. Cl.
*E04C 5/16* (2006.01)
*E04C 5/20* (2006.01)

(52) U.S. Cl.
CPC ..... *E04C 5/166* (2013.01); *E04C 5/167* (2013.01); *E04C 5/168* (2013.01); *E04C 5/20* (2013.01)

(58) Field of Classification Search
CPC ..... E04C 5/167; E04C 5/168; E04C 5/20; E04C 5/166; E04C 5/18; E04C 5/16
USPC ..... 52/688, 647, 648.1, 649.1, 677, 687, 52/741.3, 831
See application file for complete search history.

(56) References Cited

U.S. PATENT DOCUMENTS 1,841,743 A * 1/1932 Lampert ..... 52/688
1,850,401 A * 3/1932 Lampert ..... 52/688
2,154,748 A * 4/1939 Hillberg ..... 404/62
2,170,635 A * 8/1939 Emigholz ..... E04C 5/18 52/688
2,428,137 A * 9/1947 Bitney ..... E04C 5/18 52/684
3,289,378 A * 12/1966 William ..... 52/688
4,744,190 A * 5/1988 Couwenbergs et al. ..... 52/649.8
5,177,928 A * 1/1993 Fricker ..... E04G 21/142 52/707
5,626,436 A * 5/1997 Dragone ..... E04C 5/167 24/339

FOREIGN PATENT DOCUMENTS

AT 326325 B * 12/1975 ..... E04C 5/20
CH 379733 A * 7/1964 ..... E04C 5/18
CH 404153 A * 12/1965 ..... E04C 5/18
DE 1509036 A1 * 12/1968 ..... E04C 5/18
DE 19637379 A1 * 4/1998 ..... B27B 5/07
EP 0541880 A1 * 5/1993 ..... E04C 5/18
EP 1734201 A2 * 12/2006 ..... E04C 5/065
GB 1033841 A * 6/1966 ..... E04C 5/20
JP 2006177127 A * 7/2006 ..... E04C 5/20

* cited by examiner

*Primary Examiner* — Charles A Fox
*Assistant Examiner* — Joseph J Sadlon
(74) *Attorney, Agent, or Firm* — Andrew W. Chu; Craft Chu PLLC

(57) ABSTRACT

An assembly includes a reinforcement bar and a plurality of bar chair attached at spaced locations thereto. The bar chairs have an upper concave seat portion, and pairs of legs. The legs are spot welded to the reinforcement bar at locations, and at a height 'h' for the prescribed concrete cover for the reinforcement bar. The legs are located on opposing or alternating sides of the reinforcement bar to evenly distribute the construction loads onto the chair legs. As the reinforcement bar is attached to the legs of the wire form, the concave seat portion is oriented to support a reinforcement bar oriented at 90° to the reinforcement bar.

6 Claims, 9 Drawing Sheets

DUAL MESH LEVEL REINFORCEMENT BAR SUPPORT CHAIR ASSEMBLY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an improved building method and in particular to improvements in design and construction of reinforced concrete slabs.

2. Description of Related Art Including Information Disclosed Under 37 CFR 1.97 and 37 CFR 1.98.

Concrete and steel reinforced slabs, beams, columns and walls are commonly used in all aspects of the building and construction industry. The applications include roadways, bridges, car parks, slabs in commercial, industrial and residential buildings which also incorporate concrete beams, columns and an assortment of reinforced concrete shapes and designs. The reinforced concrete structures come in many different arrangements and include forms called post-tensioned, composite, precast and conventional slabs on ground or in a suspended form employing frames and formwork which is erected on site.

The vast majority of reinforced concrete structures are poured in situ and generally have deformed and hi strength steel reinforcing bars designed into them. The reinforcing bars provide the tensile strength the structures needs to support itself and the construction and design loads applied to it on the completion of its installation. Structures such as composite slabs, including ones comprising composite metal decks and precast may also require the addition of reinforcement bar in the design.

Generally all reinforced concrete structures require steel reinforcement in many different arrangements and layers. In reinforced concrete slabs designs for example, multiple layers of reinforcement steel are laid in two directions at 90 degrees to each other. A lower layer placed adjacent the bottom of the slab to be formed provides tensile reinforcement to the structure. An upper layer laid adjacent the top of the slab to be formed assists with compression loadings and concrete shrinkage control. The steel mesh, or assembly of reinforcement bar adjacent the bottom of the slab provides tensile reinforcement and the upper layer provides negative reinforcement over the supports and is also used to resist shrinkage cracking of the slab surface during the drying process. The mesh is lapped and tied together with wire so that movement of the reinforcement in constrained for the duration of the installation and the concrete pour. In some designs reinforcing bar is combined with the mesh to provide additional design strength where required.

In larger span and thicker suspended slabs, reinforcement bars are generally used in the design and installation, along with reinforcement cages in integrated concrete beams where additional span capacity is required. The reinforcement bar is designed in layers, two layers adjacent the bottom portion of the slab and two layers adjacent the top portion of the slab. Every layer has bars installed at a regular spacing running parallel to each other, the next installed layer has the bars placed at 90 degrees to the ones below and spaced equidistant from each other to the design requirements. The same applies to the construction of concrete walls using formwork shutters. In beams and columns, the main reinforcement bars laid in the direction of the column or beam usually have stirrups and ligatures tied around them, to keep the main bars in a particular arrangement for the design, as well as to transfer shear. The assembly of the primary bars and ligatures/stirrups can be termed a wire cage, and in many cases are manufactured off site using welding, and shipped to site and installed as a complete unit. In a lot of cases, the beam cages are assembled on site and take considerable time to do so, since the ligatures need to be threaded over the reinforcement bars and tied together at regular spacing along the bars and tied to the bar as well. The assembled cage can be heavy and poses considerable difficulty in chairing from the formwork to create sufficient concrete cover during the pour.

In suspended slabs, the bar installation process requires the bar spacing to be set to the engineering requirements, and the spacing is generally the same for each layer of steel although it can vary from one layer to the other. The installation process is carried out by manual labour and the occupation is termed steel fixing, and the tradesman, a Steel Fixer. The steel fixer will mark the spacing on top of the formwork for the first layer of bar and place it in accordance with the markings. The bottom steel at this point is not restrained from moving from side to side until a bar from the next layer is installed at 90 degrees to them. The bar from the first layer is then tied to the bar above while maintaining the required spacing. A difficulty in this process is the need to lift the bottom steel bar from the formwork to allow the wire tie to slide underneath and be tied to the cross bar. It becomes increasingly difficult to lift the bars from the bottom layer as the steel tying progresses because more of the previously connected bars add to the lift weight combined with careful foot placement to avoid stepping on the pre tied steel. In many cases, strip chairs are employed to support the bottom layers of steel during the tying process, which can alleviate but does not fix the problem entirely, as manual labour is still required to install and place the chairs.

After the placement and tying the first two layers, the mesh assembly is lifted and placed upon bar chairs. Sometimes this is done during the tying process. The more common bar chairs are made from wire and have four legs, hence the name chair. These are spaced at approx. 800 mm apart in a grid arrangement and are installed so the bottom two layers of mesh have adequate concrete cover when the slab is poured. Other spacing may be suitable for other sizes of steel which can support larger spans, and in cases where the compression capacity of the chair and the formwork it rests on allows it.

The process is repeated for the top two layers of reinforcement steel by building the mesh arrangement on top of the chaired bottom layer. The steel tying becomes easier since the steel is supported by the mesh below in discrete locations, rather than continuously on top of the formwork as in the first layer of the bottom steel bars. When the steel bars are tied, the top two layers are chaired to the design height by using a higher bar chair and is secured in place. Sometimes the higher bar chairs are installed first and the bars are progressively tied at the appropriate height, however managing and controlling the tying process is much more difficult. The design height of the top steel is determined by the concrete cover that is required for the concrete strength employed and environmental conditions. A difficulty in this process is in lifting the upper steel mesh while supporting the feet on the lower steel mesh below without the feet impeding the upper mesh being lifted. As the mesh opening size decreases, the difficulty in lifting the tied steel increases and as the steel fixer foot size (and subsequent boot size) increases then the difficulty in tying and lifting the upper mesh around the boots increases. Another problem associated with using taller wire chairs is they may collapse under the weight of the mesh load combined with concreters walking on the mesh during the concrete pour, reducing the strength of the reinforced concrete slab in that area if is not corrected. The tying process is slowed further by the need to continuously check the spacing of the bars and to maintain the engineered design of the amount of steel cross sectional area per meter of span of slab at right angles to the direction of the bars.

The chairing requirements are also applied to pre made mesh, the bottom layer is chaired above the formwork, and the top layer is supported by another chair installed afterwards.

Reinforcement bar is supplied to site in deformed and straight lengths ready for installation by the steel fixers. All the reinforcement bars and deformed bars are located in the slab by a numbering system which is part of the steel scheduling system. None of the bars carries any particular information on them except when they are bundled together and tied together, the attached tag lets the steel fixer know where these bars are to be installed on the reinforcement schedule layout.

Bar chairs and other ancillary fixing equipment is supplied separately and are called accessories.

The manufacturing systems generally delivers bars to particular shapes and to particular lengths and has no ability to build in smart information with the manufactured component and bring it to the site so that the steel fixers may know, without reference to drawings at what spacing and how to install it.

The present invention aims to overcome or alleviate the above disadvantages by providing a more cost effective and user friendly way of providing chair support in the early stages of reinforcement bar installation and provide a simpler method of lifting and tying the steel.

The present invention seeks to overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

According to a first aspect, the present invention provides an assembly comprising:

an elongate reinforcement bar; and at least one bar chair having an upper seat and spaced legs extending downwardly from the upper seat, wherein at least one of the legs of each bar chair is attached to the reinforcement bar at a position along the at least one leg between the upper seat and a lower end of the at least one leg.

In a preferred embodiment, the assembly comprises two or more bar chairs attached to the reinforcement bar at spaced locations along the reinforcement bar.

In another preferred embodiment, each bar chair has two legs thereof attached to the reinforcement bar.

In another preferred embodiment, the two legs of each bar chair are attached to opposite sides of the reinforcement bar.

In another preferred embodiment, lower ends of the bar chair legs are plastic coated and/or galvanised.

In another preferred embodiment, each bar chair comprise two sets of opposed legs, with a first set of legs spaced from each other by a larger distance than the spacing between a second set of legs, wherein the reinforcement bar is attached to the first set of legs.

The present invention in another aspect provides a method of forming a lower mesh of reinforcement bars for a concrete structure using the assembly of any one of the above, the method comprising:

placing a plurality of the assemblies in position with first reinforcement bars of the assemblies parallel to and spaced from each other, the bar chairs of adjacent assemblies being disposed to form aligned rows;

placing second layer cross reinforcement bars perpendicular to and on top of the first reinforcement bars, wherein a respective second layer cross reinforcement bar is disposed adjacent each row of the bar chairs; and tying the second layer cross reinforcement bars to the bar chairs and the first reinforcement bars at the respective intersections thereof.

In a preferred embodiment, the method further comprises the steps of:

before placing the second layer cross reinforcement bars, laying first layer intermediate reinforcement bars on the formwork or ground between and parallel to the first reinforcement bars, and after placing the second layer cross reinforcement bars, pulling the first layer intermediate reinforcement bars to the underside of the cross reinforcement bars and tying the reinforcement bars to each other at intersections thereof.

In another preferred embodiment, the method further comprises the steps of placing second layer intermediate reinforcement bars between and parallel to the second layer cross reinforcement bars, on top of the first and intermediate reinforcement bars and tying the reinforcement bars to each other at intersections thereof.

In another preferred embodiment, the method further comprises the steps of forming an upper mesh, comprising the steps of:

placing a respective third layer reinforcement bar on top of the aligned seat portions of the respective rows of bar chairs, placing fourth layer cross reinforcement bars perpendicular to and on top of the third layer reinforcement bars, and tying the third and fourth layer reinforcement bars to the bar chairs.

In another preferred embodiment, the method further comprises the steps of:

before placing the fourth layer cross reinforcement bars, laying third layer intermediate reinforcement bars on the lower mesh between and parallel to the third layer reinforcement bars, and after placing the fourth layer cross reinforcement bars, pulling the third layer intermediate bars to the underside of the fourth layer cross reinforcement bars and tying the reinforcement bars to each other at intersections thereof.

In another preferred embodiment, the method further comprises the steps of placing fourth layer intermediate cross reinforcement bars between and parallel to the fourth layer cross reinforcement bars, on top of the third layer reinforcement bars and tying the reinforcement bars to each other at intersections thereof.

The present invention in another aspect provides a bar chair assembly for forming a lower mesh and an upper mesh of reinforcement bars, the bar chair assembly comprising:

a lower component for supporting the lower mesh at a first height spaced from the ground; and an upper component attachable to the lower component for supporting the upper mesh at a second higher height spaced from the ground.

In a preferred embodiment, the lower component comprises a base and the upper component comprises legs, the base and the legs comprising corresponding attachment means for attachment with each other.

In another preferred embodiment, the upper component comprises legs having male locking tabs and the lower component comprises a base having a corresponding receiving locking ridge.

In another preferred embodiment, the lower component comprises a hollow upright section comprising two pairs of differently sized openings at a top portion thereof, the pairs of openings being oriented perpendicularly to each other.

In another preferred embodiment, the pairs of openings comprise entry slots for press fitting onto reinforcement bars, wherein the slots substantially prevent movement of the lower component from or along the reinforcement bar.

In another preferred embodiment, the upper component comprises a hollow upright body comprising two pairs of slots at a top portion thereof, the pairs of slots being oriented perpendicularly to each other pair.

In another preferred embodiment, the two pairs of slots are disposed at different height levels.

In another preferred embodiment, the upper component comprises openings formed into side walls thereof, the openings being dimensioned to allow reinforcement bars mounted to the lower component to extend therethrough and allow concrete to enter and fill the voids within the chair bar assembly.

Other aspects of the invention are also disclosed.

BRIEF DESCRIPTION OF THE DRAWINGS

Notwithstanding any other forms which may fall within the scope of the present invention, preferred embodiments of the present invention will now be described, by way of examples only, with reference to the accompanying drawings.

FIG. 1 is a perspective view of a wire bar chair with galvanized tips.

DETAILED DESCRIPTION OF THE DRAWINGS

Figure 1A:
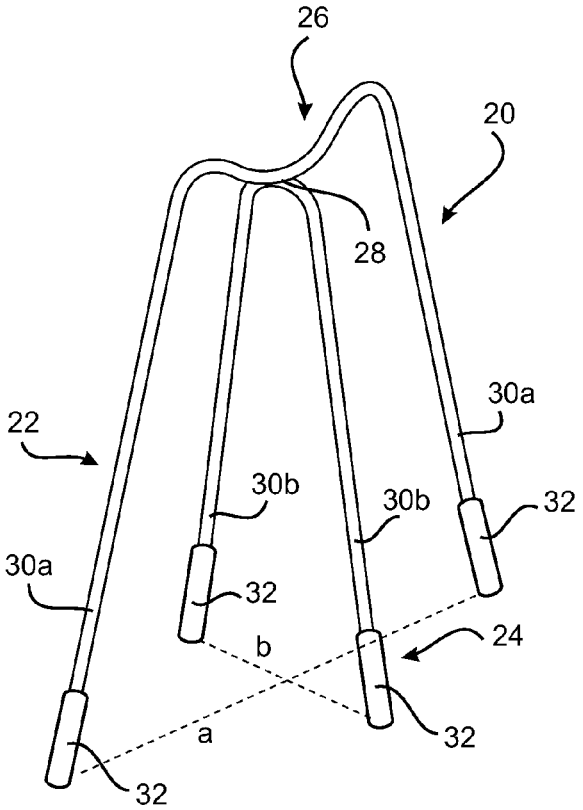
FIG. 1 (*a*) is a perspective view of a plastic tipped wire bar chair and (*b*)

It should be noted in the following description that like or the same reference numerals in different embodiments denote the same or similar features.

Figure 1B:
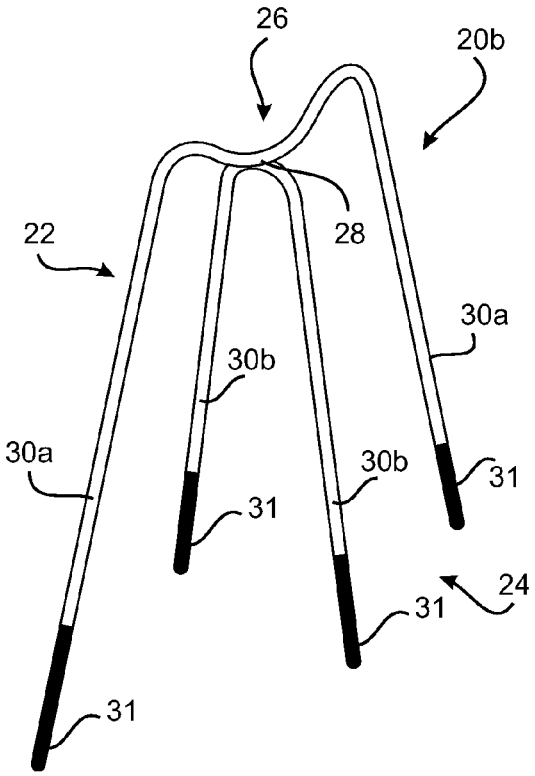

FIG. 1(*a*) shows a plastic tipped wire bar chair 20 which comprises two separate wire forms 22 and 24, both shaped generally as an inverted U-shape. The top of the wire form 22 has a concave seat portion 26. The wire form 22 comprises legs 30*a* and the wire form 24 comprises legs 30*b*. The wire forms 22 and 24 are oriented at 90 degrees to each other and their top portions are welded together at 28. The formed wire bar chair 20 has two sets of opposed legs 30, with legs 30*a* at spacing 'a' and legs 30*b* at spacing 'b'. Spacing 'a' is larger than spacing 'b'. Lower ends of the legs 30 are dip covered with plastics material 32 when used in applications where the bottom of the slab is exposed. The recess 26 is used to support an upper reinforcement bar (also called 'reo' or 'rebar').

FIG. 1(*b*) shows an alternative covered tipped wire bar chair 20*b* showing legs 30 having partly galvanised portions 31. The galvanised portions 31 are to a nominal length which is determined by the corrosive environment it is to be installed into. The galvanised portions 31 may also be covered in plastics material in the conventional way to increase its corrosion resistance when used in extreme environment.

Figure 2:
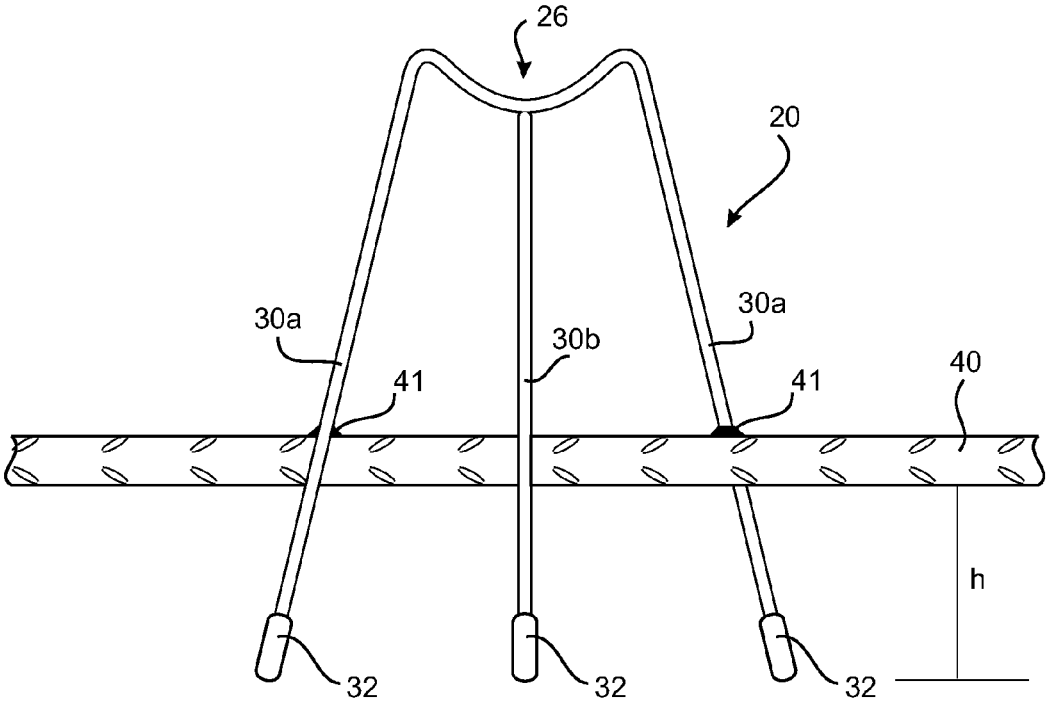
FIG. 2 is an elevation view of a reinforcement bar welded to legs of the wire bar chair of FIG. 1.
Figure 3:
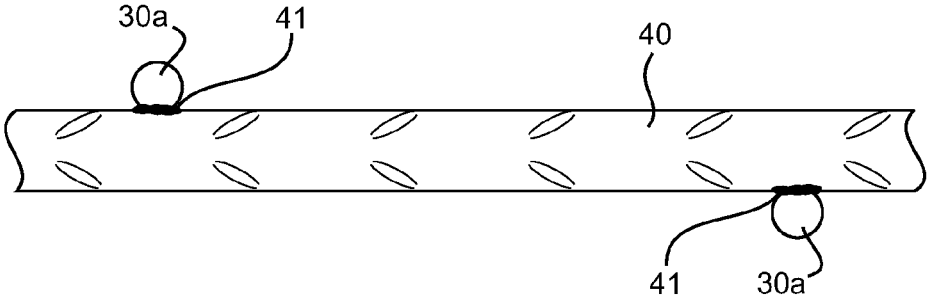
FIG. 3 is a plan view of a section of the wire bar chair legs attachment to the reinforcement bar of FIG. 2.

FIGS. 2 and 3 show a reinforcement bar 40 spot welded to the legs 30*a* of the wire bar chair 20 at locations 41, and at a height 'h' for the prescribed concrete cover for the reinforcement bar 40. The legs 30*a* in the preferred form of the invention are located on opposing or alternating sides of the reinforcement bar 40 to evenly distribute the construction loads onto the chair legs 30. As the reinforcement bar 40 is attached to the legs 30*a* of the wire form 22, the concave seat portion 26 is oriented to support a reinforcement bar oriented at 90° to the reinforcement bar 40.

Figure 4:
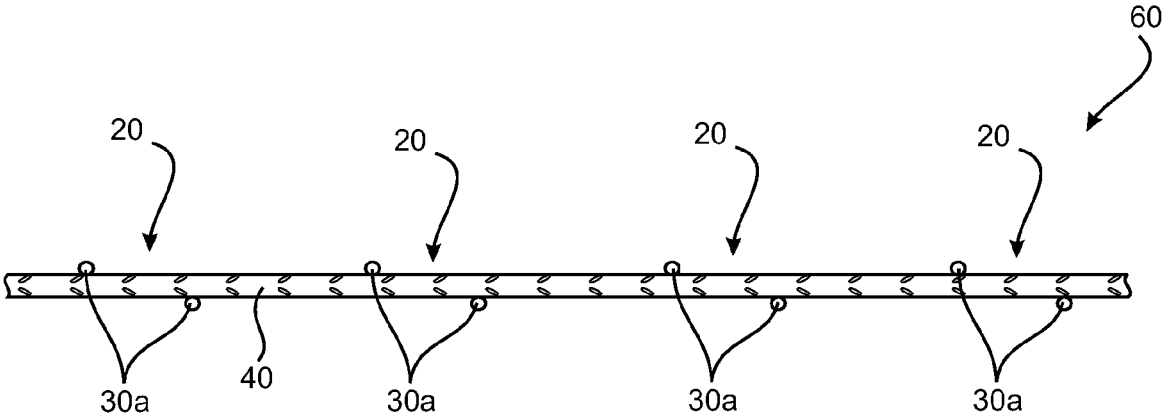
FIG. 4 is a plan view of a section of an assembly comprising a plurality of wire bar chairs with the leg arrangement in FIG. 3 spaced along a reinforcement bar.
Figure 5:
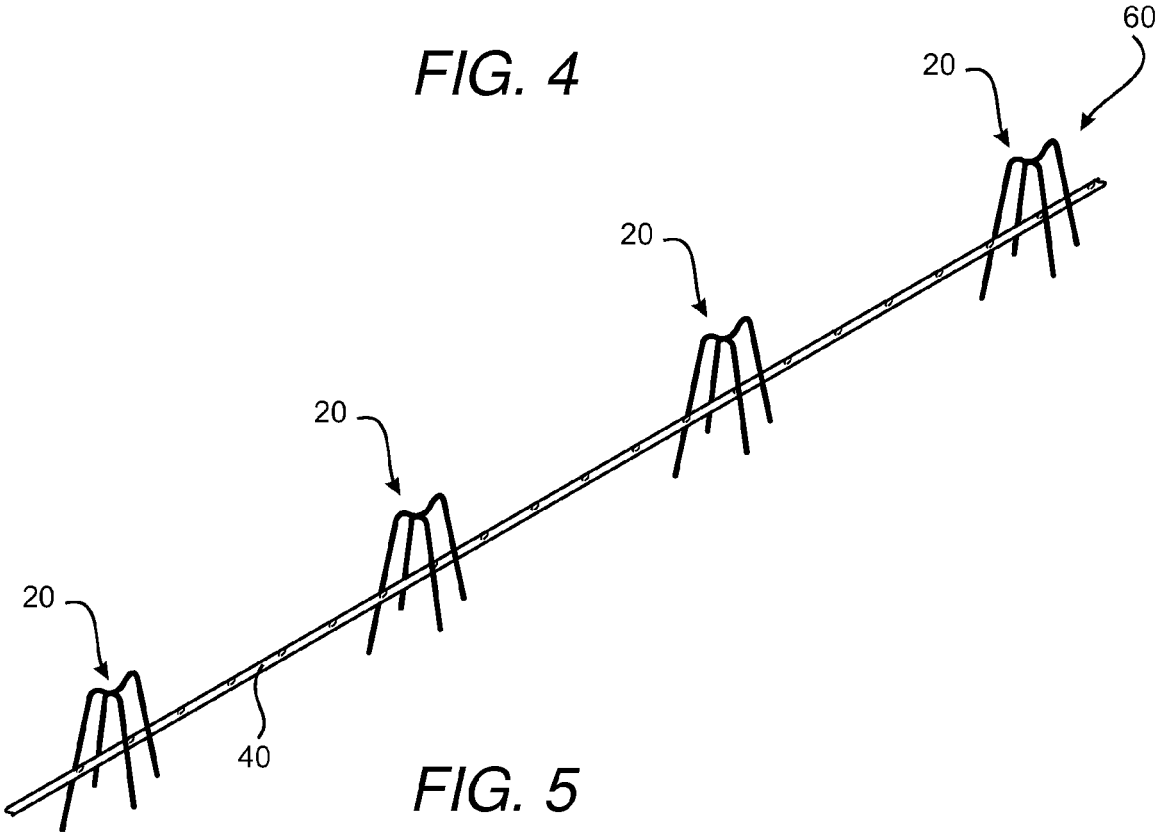
FIG. 5 is an isometric view of the assembly of FIG. 4.

FIGS. 4 and 5 shows an integrated wire bar chair and reinforcement bar assembly 60 comprising the reinforcement bar 40 with spaced integrated wire bar chairs 20. The legs 30*a* of the bar chairs 20 are attached to the reinforcement bar 40 according to the orientation shown in FIGS. 2 and 3. The concave seat portions 26 are disposed to extend along the reinforcement bar 40 and will support respective additional reinforcement bars oriented at 90° to the reinforcement bar 40 as further described below.

Figure 6:
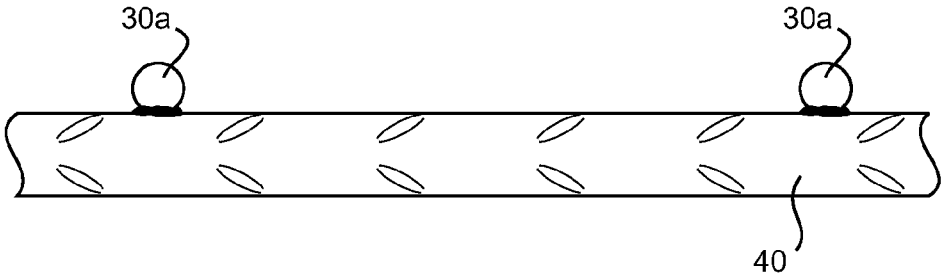
FIG. 6 is a plan view of a section of an alternative wire bar chair leg attachment to a reinforcement bar.
Figure 7:
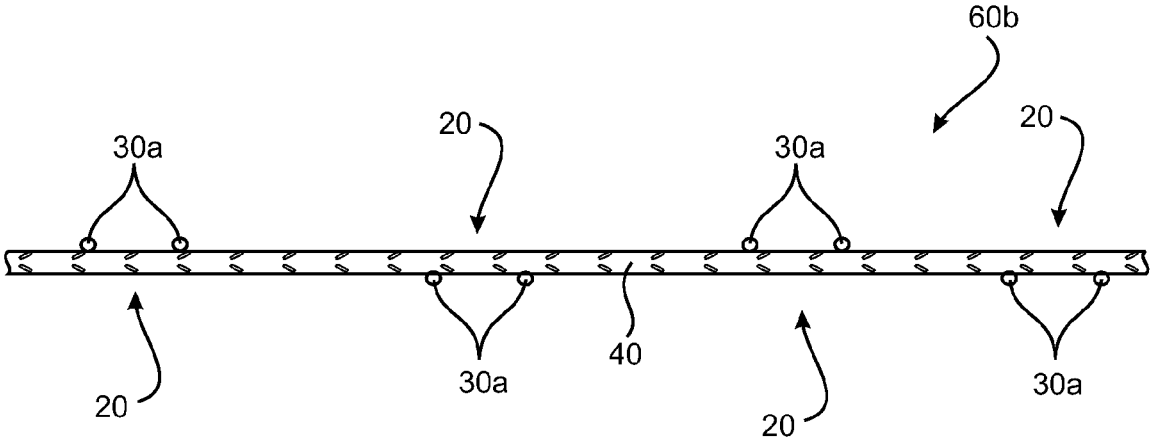
FIG. 7 is a plan view of a section showing a plurality of wire bar chairs with the leg arrangement in FIG. 6 spaced along a reinforcement bar.

FIG. 6 shows an alternative arrangement of the legs 30*a* to the reinforcement bar 40 with the legs 30*a* of each bar chair 20 being welded to one side only of the reinforcement bar 40. This arrangement may be suited for smaller reinforcement bar diameters to maximise production efficiencies, where other welding means such as projection welding can be used to join the chair legs 30*a* to the reinforcement bar 40. FIG. 6 show an alternative assembly 60*b*, where the legs 30*a* of adjacent bar chairs 20 are attached to alternating sides of the reinforcement bar 40.

Figure 8:
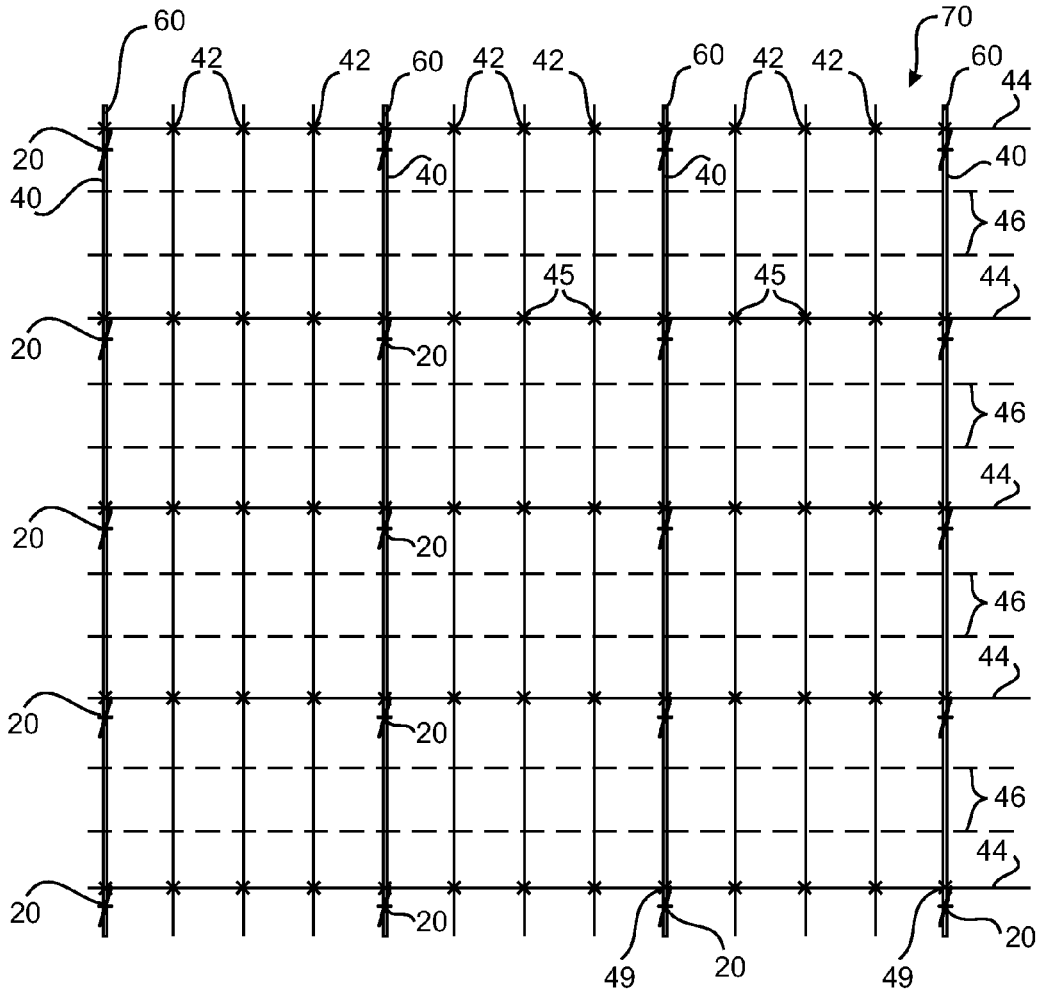
FIG. 8 is a plan view of an example lower steel mesh showing installation of first and second layers of reinforcement bars.
Figure 9:
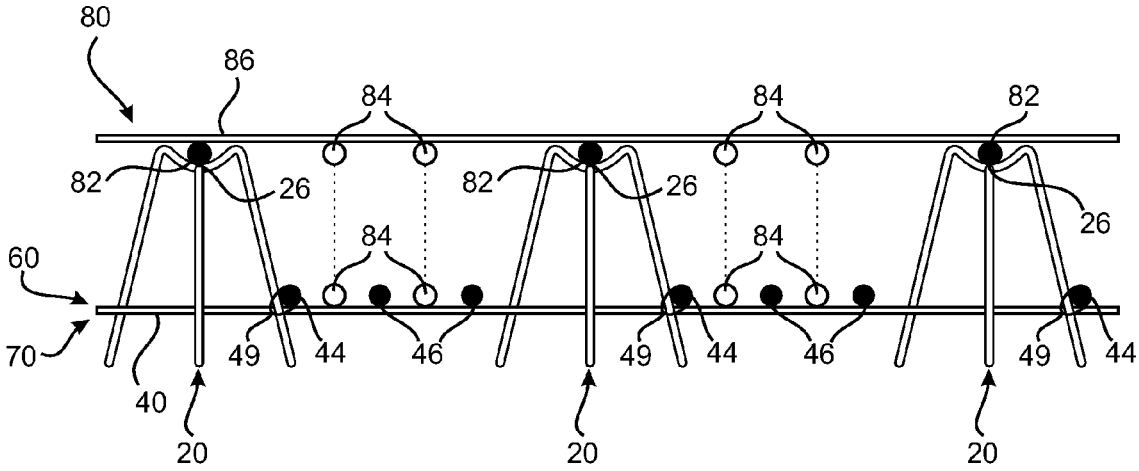
FIG. 9 is an elevation view showing the addition of a third layer of reinforcement bars to the assembly of FIG. 8 for forming an upper steel mesh.

FIGS. 8 and 9 show an example installation of the bottom two layers of reinforcement bars for forming a lower steel mesh 70. A plurality of the assemblies 60 are placed in position with their (first) reinforcement bars 40 parallel to each other at (in this example) 800 mm centres (spacings). The bar chairs 20 of the adjacent assemblies 60 are disposed to form aligned rows. First layer intermediate reinforcement bars 42 are placed and spaced evenly on the formwork or ground between and parallel to the reinforcement bars 40. In the example, three reinforcement bars 42 are disposed between each adjacent pair of reinforcement bars 40.

Second layer cross reinforcement bars 44 are laid perpendicular to and on top of the reinforcement bars 40, with a respective reinforcement bar 44 disposed for each row of the bar chairs 20. The reinforcement bars 44 are disposed adjacent the intersection between one chair leg 30*a* and the reinforcement bar 40, and the reinforcement bars 40 and 44 and leg 30*a* are tied together with wire 49. All the integrated bar chair assemblies 60 are tied to the reinforcement bar 44 until all intersecting locations are fixed. The intermediate bars 42 (currently disposed on the ground/formwork) are then pulled up to the underside of reinforcement bars 44 and tied into position at the prescribed intersection locations 45. Second layer intermediate cross reinforcement bars 46 are then laid between and parallel to the cross reinforcement bars 44, on top of the reinforcement bars 40 and 42. The intersecting bars are tied together at the design locations and frequency. This completes the lower mesh 70.

Once the two layers of steel reinforcement bars 40 of the lower mesh 70 are tied in place, formation of the upper mesh 80 is initiated. A third layer reinforcement bar 82 is disposed on top of the aligned seat portions 26 of the respective rows of bar chairs 20, and tied into position thereto as required to hold in place. The reinforcement bars 82 are thus parallel to the cross reinforcement bars 44.

After all the reinforcement bars 82 have been installed, third layer intermediate bars 84 are placed on top of the lower mesh 70 between and parallel to the intermediate cross reinforcement bars 46. Fourth layer reinforcement bars 86 are then installed on top of the bar chairs 20 and reinforcement bars 82, and perpendicular to the reinforcement bars 82, and progressively tied in place with wire at all intersecting locations. The intermediate reinforcement bars 84 are then pulled up from the lower mesh 70 and tied to the underside of reinforcement bars 86 at the required spacing. Additional fourth layer reinforcement bars are then installed parallel to and between the reinforcement bars 86 and tied to the reinforcement bar 84 as required. This completes the upper mesh 80.

The integrated wire bar chair and reinforcement bar assemblies 60 thus allow for the quick formation of dual layer mesh assemblies with minimal bar chair placement involved.

Figure 10:
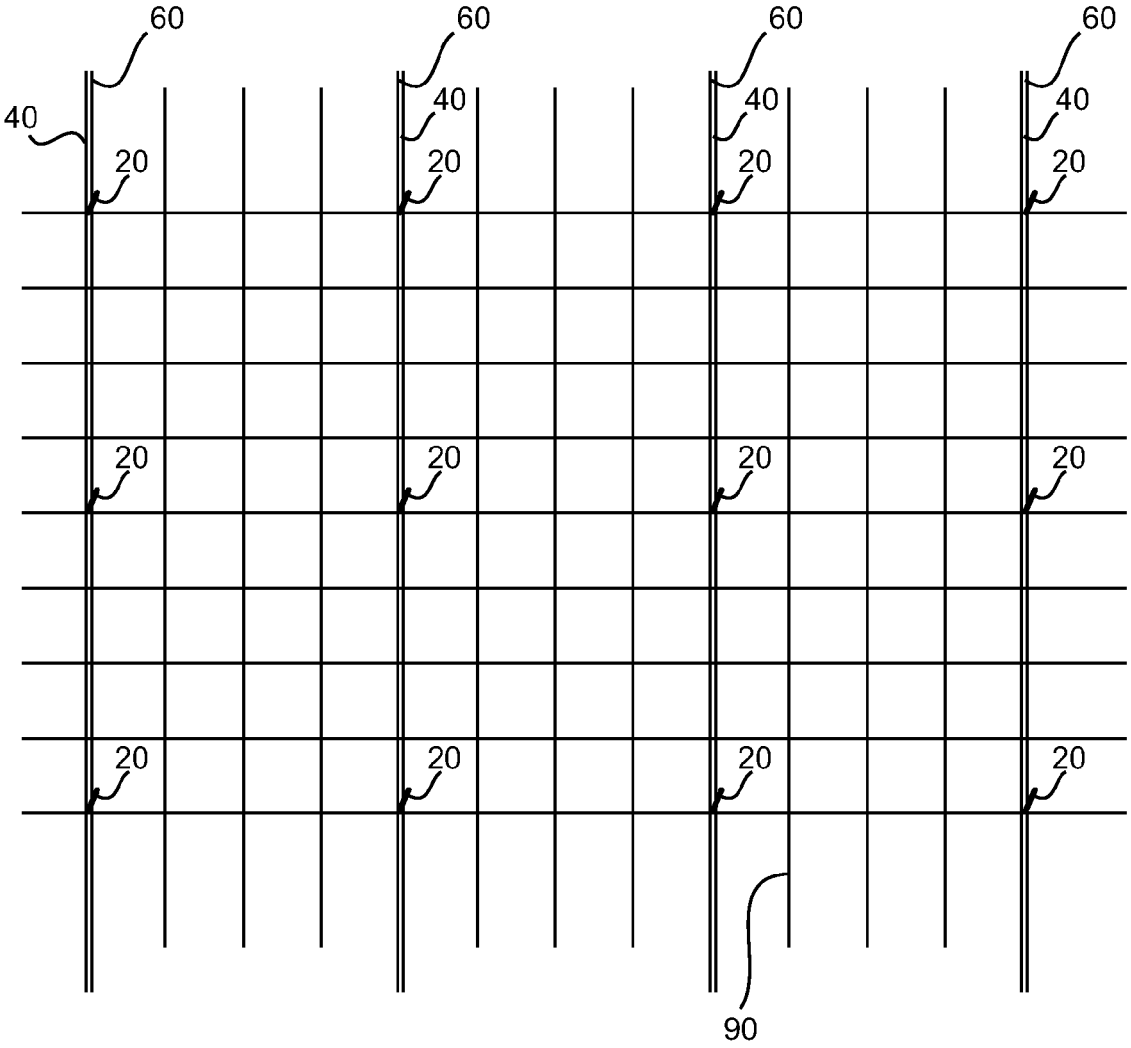
FIG. 10 is a plan view of an alternative assembly comprising the reinforcement bars with integrated bar chairs of FIG. 7 supporting lower and upper layers of welded mesh.

FIG. 10 shows a plan view of integrated bar chair assemblies 60 evenly spaced apart with pre made welded lower mesh 90 installed on top of the reinforcement bars 40. Another welded upper mesh can then be installed on top of the bar chairs 20 with its bars located at the seat portions 26 of the bar chairs 20. The lower and upper mesh are tied to the integrated bar chair assemblies 60 at the reinforcement bars 40 and at the seat portions 26 respectively.

Figure 11:
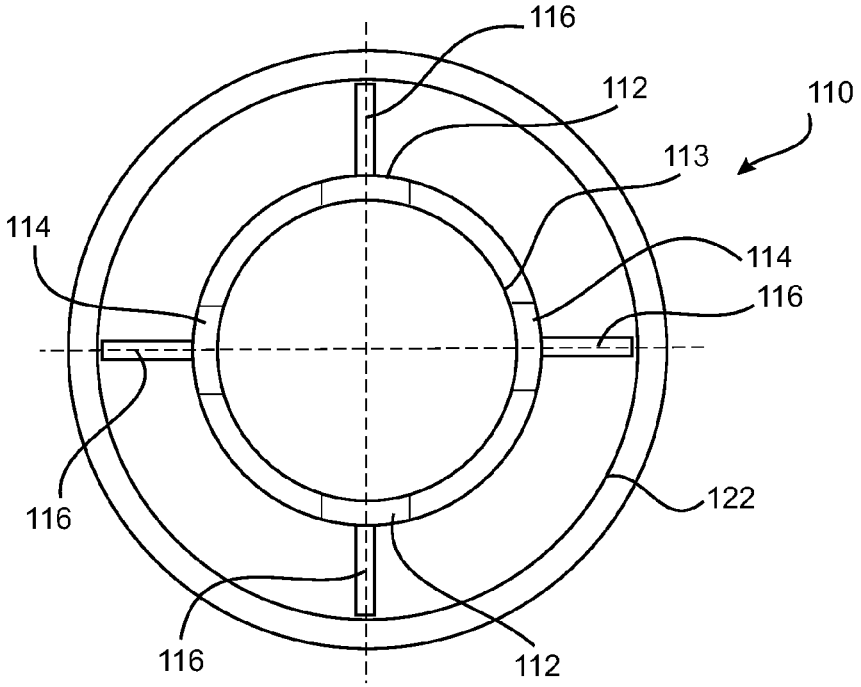
FIG. 11 is a plan view of a lower plastic bar chair component for a dual mesh level bar chair assembly according to another embodiment of the present invention.
Figure 12A:
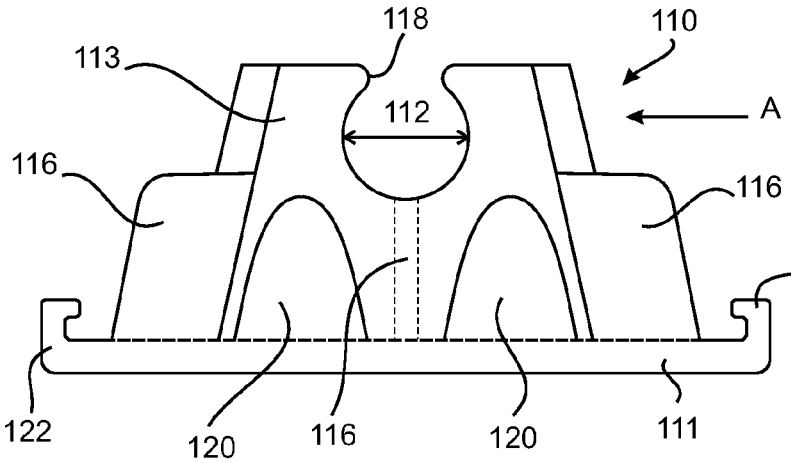
FIG. 12 (*a*) is an elevation view of the bottom plastic chair component of FIG. 11, and (*b*) is a part view in the direction of arrow A.
Figure 12B:
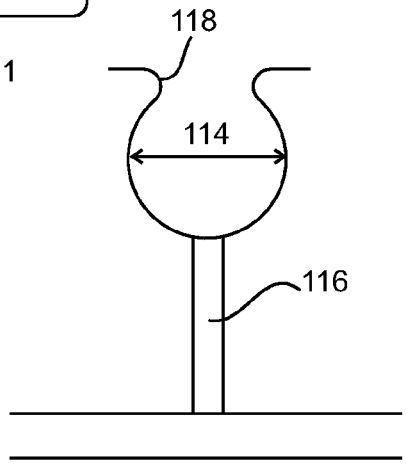

FIGS. 11 and 12 show a lower plastic bar chair component 110 for a dual mesh level bar chair assembly 100 according to another embodiment of the present invention. The lower component 110 is a moulded unit and comprises a circular base 111 with a hollow tubular upright central section 113 extending upwardly therefrom. The central section 113 has two pairs of differently sized rounded openings 112 and 114 at a top portion thereof, each pair of openings 112 and 114 being disposed at diametrically opposing sections of the central section 113. The pair of openings 112 are oriented perpendicularly to the pair of openings 114. The pairs of openings 112 and 114 can be press fitted onto two different sized reinforcement bars. Stiffening ribs 116 extend between the central section 113 and the base 111 which can withstand the loading from the mass of the reinforcement bars which sits thereon.

The central section 113 includes shaped slots 118 for each opening 112 and 114, which can be pressed onto a reinforcement bar in a production line by press machines. The slots 118 are designed to clamp on the deformations 141 of the reinforcement bar 40 as shown in FIG. 13 and to resist movement along the reinforcement bar 40, as the distance between the pressed lower components 110 assembled onto the reinforcement bar 40 is used to determine the spacing of intermediate bars during the steel fixing operation on site.

Figure 13:
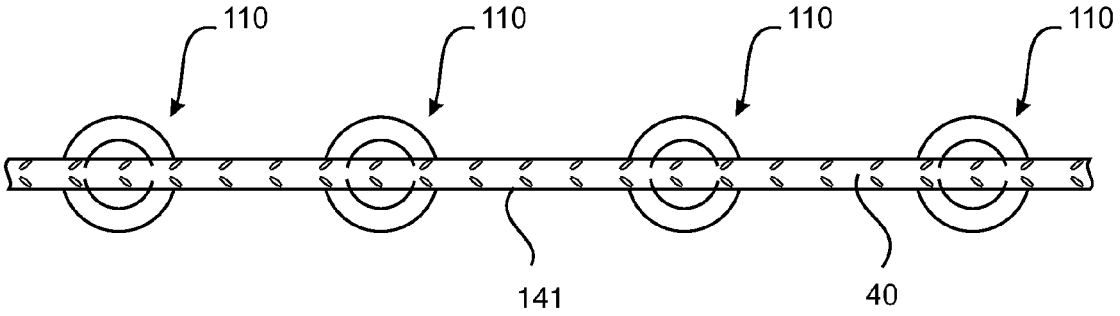
FIG. 13 is a plan view showing a plurality of spaced lower chair components of FIGS. 11 and 12 fixed to a reinforcement bar.

FIG. 13 shows a reinforcement bar 40 with lower components 110 installed at regular spacings along the reinforcement bar 40. The openings 112 and 114 are shaped to press fit onto the reinforcement bar 40 so the assembly can be moved around on site without the lower components 110 falling off or needing to be tied on the reinforcement bar 40, and the lower components 110 will hold the nominated spacing (i.e. wont slide along the bar 40). Each lower component 110 is sized to suit a reinforcement bar, i.e. opening 112 can be designed to connect to a 12 mm bar, and the openings 114 perpendicular to it may be sized to connect to a 16 mm bar. Another lower component 110 can be designed to suit a 20 mm reinforcement bar and a 24 mm reinforcement bar. The lower components 110 are made the same so the bottom of the openings 112 and 114 are in alignment to keep the concrete cover the same. The reinforcement bar that fits into either of the openings will have a predetermined distance from the bottom of the concrete slab to the bottom of the bar, and this distance is independent of the bar diameter, so that the reinforcement bar sits above the formwork will be of a uniform height.

The central section 113 also includes apertures 120 in the sides thereof to allow concrete to enter and encase the reinforcement bar 40 and fill the internal void of the bar chair assembly 100. A female locking ridge 122 are formed into the rim of the base 111 for locking with the upper component 140 as described below.

Figure 14:
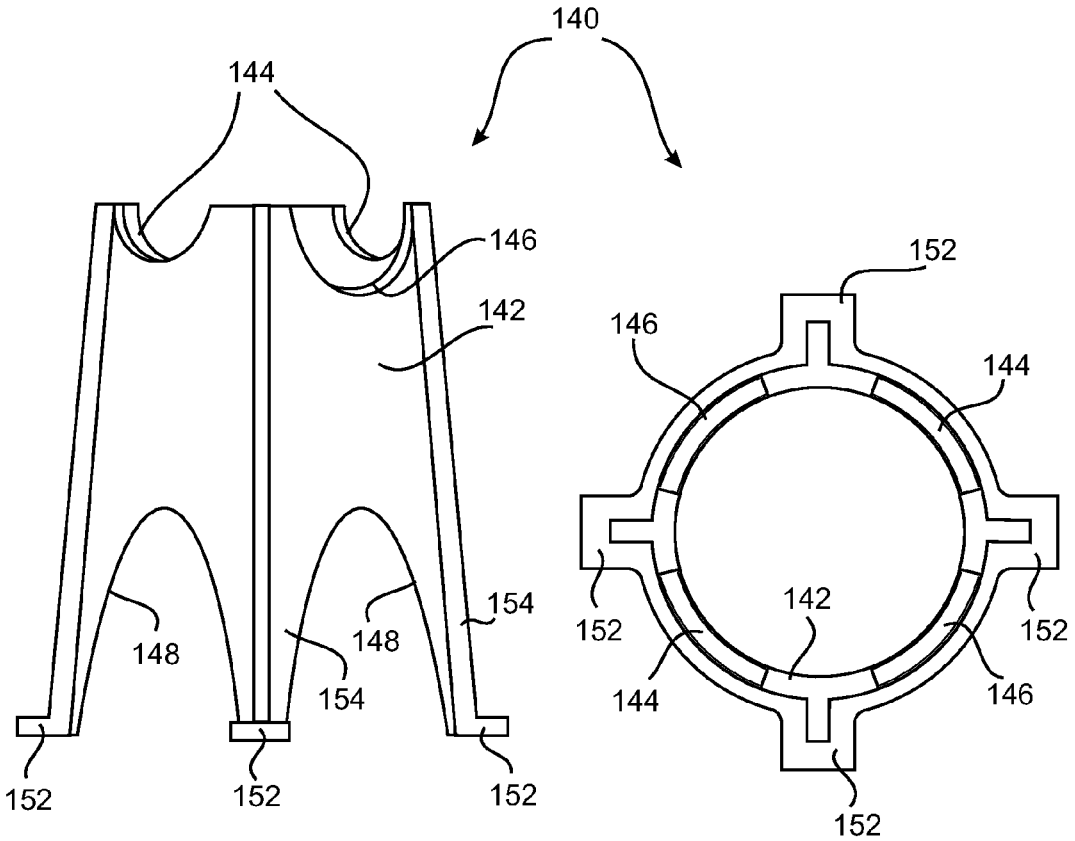
FIG. 14 (*a*) is an elevation view and FIG. 14 (*b*) is a plan view of a plastic upper chair component for the dual mesh level bar chair assembly.

FIG. 14 shows the upper component 140 of the bar chair assembly 100. Each upper component 140 is installed to the lower component 110 after a lower mesh 70 comprising two layers of reinforcement bars are installed to the lower component 110. The lower mesh 70 is installed in a similar manner as per the method above.

The upper component 140 is also a plastics material moulded component, comprising an upright generally rectangular hollow section body 142. An upper end of the upper component 140 comprises two pairs of slots 144 and 146, with the pairs oriented perpendicularly to each other. The slots 144 and 146 are set at different levels with a height difference of 10 mm therebetween. The upper component 140 comprises archway shaped openings 148 formed into lower side walls thereof and dimensioned to allow the reinforcement bars of the lower component 110 to extend therethrough and also allow concrete to enter and fill the voids within the chair bar assembly 100.

Male locking tabs 152 are formed at the legs 154 of the upper component 140, the tabs 152 shaped and dimensioned to lock into the mating female locking ridge 122 of the lower component 110. This stabilises the resulting chair bar assembly 100 and stops the legs 154 of the upper component 140 from spreading outwards.

Upper layers of reinforcement bars can then be installed on top of the upper component 140 using the slots 144 and 146 which set the appropriate heights of the third layer of reinforcement bars below the top of the concrete slab to be formed. The upper component 110 is supplied in various heights to suit a range of slab depths.

The plastic lower component 110 provides a means of achieving a snap on solution to the reinforcement bar reinforcement bar rather than a welded one. The upper component 140 with its various heights accommodate the different slab depths/thicknesses.

Figure 15:
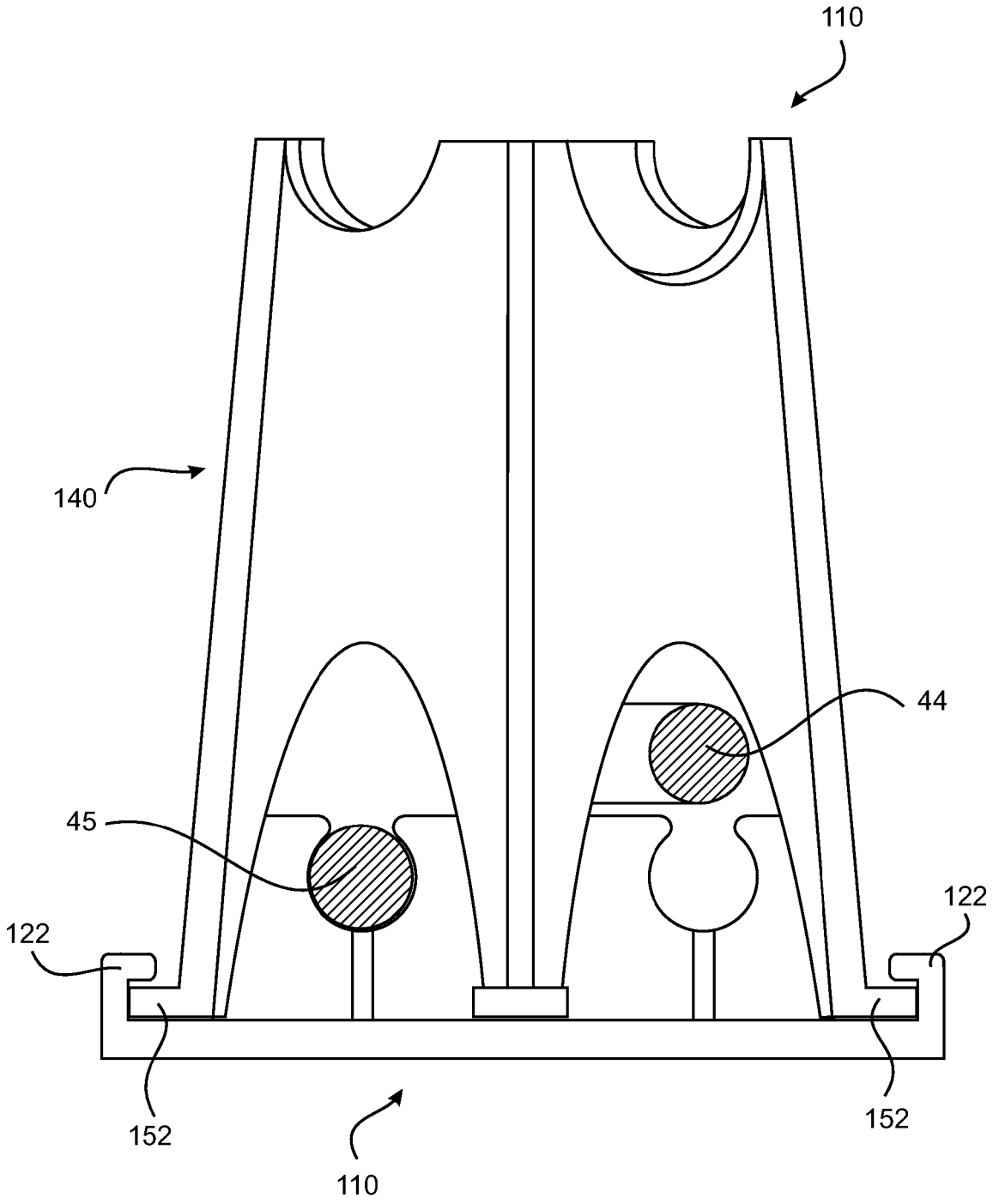
FIG. 15 is an elevation and part sectional view showing the lower and upper chair components assembled to form the dual mesh level bar chair assembly, with two layers of reinforcement bar installed to the lower chair component.

FIG. 15 shows the assembled bar chair assembly 100, with the male locking tabs 152 of the legs 154 fitted into the female locking ridge 122. FIG. 15 also shows an installed first layer reinforcement bar 40 and second layer reinforcement bar 44 installed extending through the archway openings 148. The upper layer reinforcement bars are installed at either the slots 144 or 146 depending on the height required as these locations differ by 10 mm, which is a conventional size difference in bar chairs.

Figure 16:
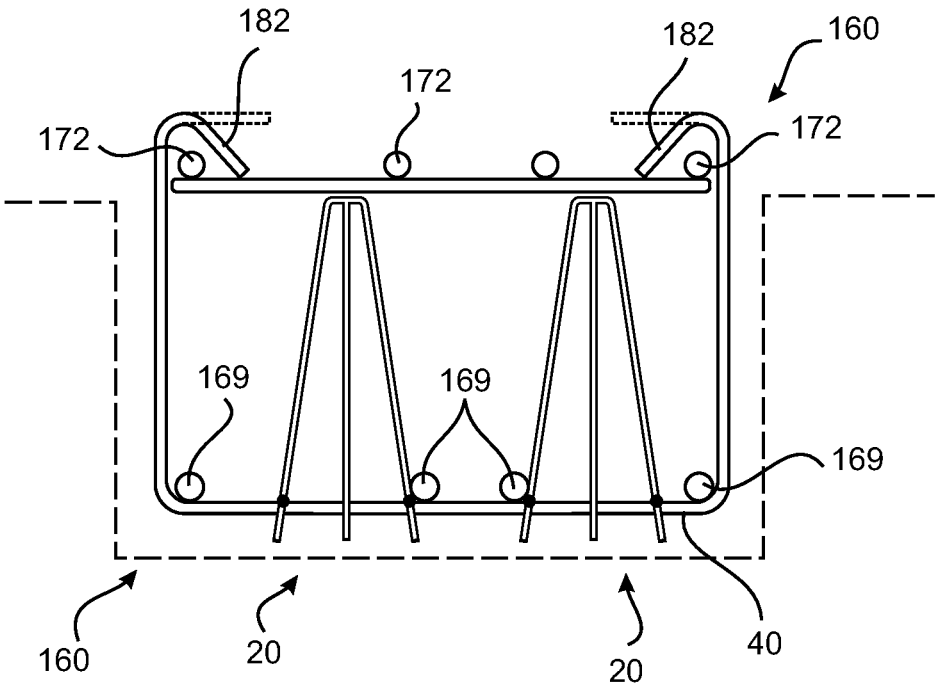
FIG. 16 is an example sectional view through a reinforcement cage for a concrete beam showing a wire chair prefixed to a stirrup.
Figure 17:
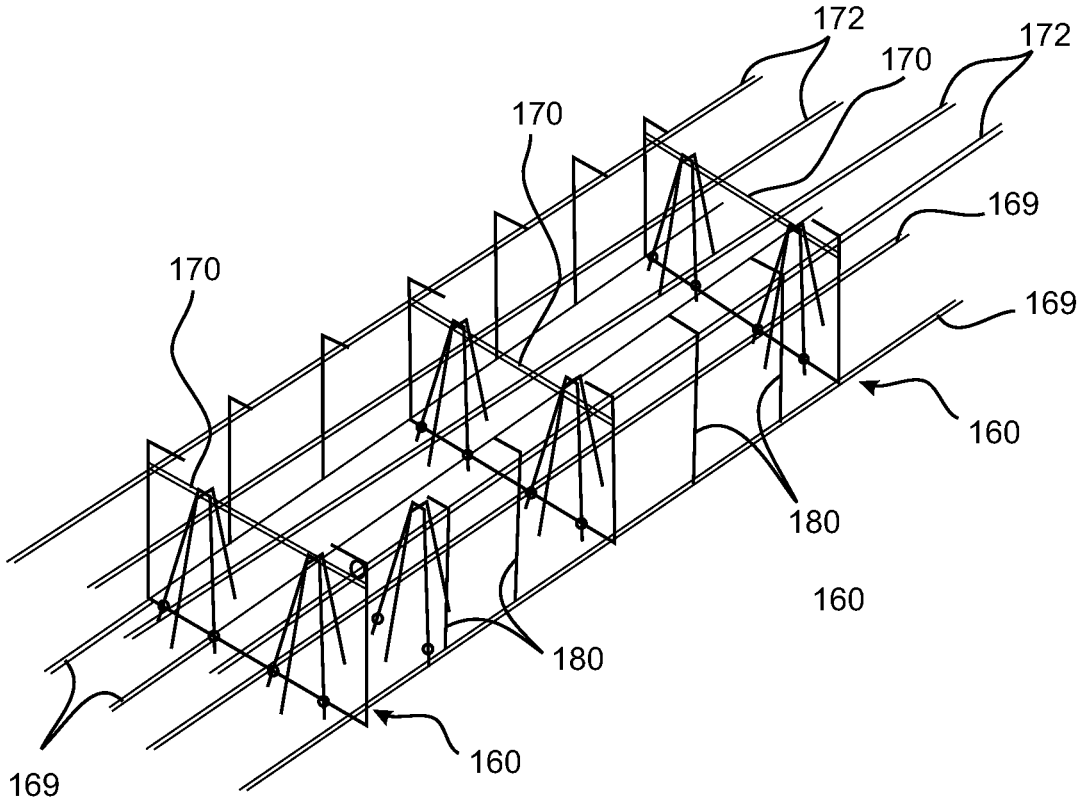
FIG. 17 is an isometric view of an assembled integrated stirrup and chair beam cage with intermediate stirrups installed.

FIGS. 16 and 17 show a chair and stirrup welded assembly 160 comprising bar chairs 20 with integrated bars 40. The assemblies 60 are spaced along the length of the concrete beam at specific spacing, and allows reinforcement bars 169 to be installed on top of the reinforcement bars 40. A support bar 170 is then installed on top of the bar chairs 20 and top reinforcement bars 172 are installed on top of the support bar 170. Intermediate stirrups 180 are moved into position between the integrated bar chair assemblies. Top legs of the stirrups are bent into a hook 182 around the top reinforcement bars 172 at each side thereof. FIG. 9 shows a portion of an assembled beam cage with chair and stirrup assemblies 160 and stirrups 180 in position.

Wire bar chairs come in a number of heights and designs to suit the concrete cover and reinforcement design in concrete slabs. Generally they are commercially available in increments of 5 and 10 mm and when they are used with conventional formwork with exposed soffits, the bottom portion of the wire legs are covered in plastic to protect them from corrosion. A disclosure of this invention is the bottom 30 mm of the legs of the wire bar chair may be hot dipped galvanised prior to covering the leg ends with plastic or not at all. In another aspect of the present invention, a flat metal plate made from stainless steel of heavy galvanised coating may be used to rest the wire bar chair on when the bottom of the slab is exposed to severe marine environments, the plate is left in place and provides corrosion protection to the base of the plastic tipped chairs and can be rendered over or painted. The wire chairs are generally spaced at no greater distance than 800 mm apart, in both orthogonal directions, however other spacing may be desirable. The wire ties are made from two separate pieces of wire that are each formed into different shapes with a concave portion at the top to locate the bar. One of the pieces has a wide spread of legs than the other, so that when they are projection welded together and placed on a flat surface the points of the legs form an elongate diamond pattern if the four leg positions were joined together by line. The wider spaced legs may collapse by spreading under the applied loadings during construction prior to and during concrete placement. The higher the bar chair the more likely leg collapse will happen as the wire size generally remains the same for all the bar chairs.

The present invention aims to increase the loading capacity of the chair by restraining the spread of the bar chair legs in the weaker direction. This is addressed by welding or otherwise fastening the legs of the wire bar chair to the reinforcement bar. The connection of the bar chair legs in this way shortens the column length and thus increases its compression loading, and restrains the legs against spreading on hard and slippery formwork surfaces, again maximising its load carrying capacity. By referring to the engineering design of the slab the size and spacing of the reinforcement bar is determined. The size of the bar in the bottom most reinforcement layer (engineers refer to as "lay first" or A layer) is used as the bottom restraint of the bar chairs. With reference to the spacing of the second layer of steel, the spacing of the bar chairs along the restraint bar is determined. For example, if the bottom steel is N12 at 200 ctrs (centres), and the lay second steel is N12 @ 250 ctrs, the lay third steel is N12 @250, top steel is N12 @ 200 ctrs and the thickness of the concrete slab is 200 mm with 30 mm cover to the top steel, and 30 mm cover bottom steel, the chair spacing will be 3×250=750 mm in this example, along the reinforcement bar. The restraining bar in this example is N12 although other standard diameter bars are available and can equally be employed in the invention.

The height of the bar chair is 200−30−12 (thickness of top steel reinforcement bar)−12 (thickness of steel reinforcement bar directly underneath) equals=158 Therefore the height of the bar chair is 150 mm.

The height of the bottom steel reinforcement bar above the tip of the bar chair is 30 mm, and this is the concrete cover thickness for the bottom steel.

The spacing of the bar chair along the restraint bar is 3×250 spacing=750 (less than or equal to 800 max chair spacing.)

The spacing of the integrated bar chair is 4×200 spacing=800 (less than or equal to 800 mm spacing of the chair bars)

To manufacture an integrated bar chair assembly, the reinforcement bar is laid out in a jig so that the clearance between the underside of the reinforcement bar is 30 mm above the table, which corresponds to the bottom steel concrete cover. The 155 mm high bar chairs are placed along the restraining bar at 750 mm centres and in the preferred orientation, one of the legs in the larger span orientations is place against one side of the bar, and the other leg is placed on the opposite side of the bar. Other arrangements of having the bar chair legs on one side only, or on one side and the next bar chair on the other sides are possible, although the object of alternating the leg position of the bar is to stabilise the loading through the chair. If the restraint bar is only attached to one side of the chair legs, the load centre applied to the legs is eccentric and may load the nearest leg at right angles to it more than the other side and this affect will increase as the bar thickness increases. When all the wire bar chairs are located along the restraining bar they are each tack welded to the side of the bar, using as little weld as possible so as to avoid impacting the tensile property of the bar. Another aspect of the present invention is to use the location of the bar chairs along the restraining bar as guidance for the steel fixer to easily locate and position intermediate bars. For instance second and third layer of steel may be at 200 mm, 250 or 300 mm spacing, so the spacing of the chairs along the bar may be 800 (4×200 mm), 750 (3×250 mm) or 900 (3×300 mm), respectively and these spacing may be increased when the reinforcement bar diameter is greater than 12 mm. For bar chairs at 200 mm spacing in the first instance, and the chair spacing at 800 mm, it is easy for the steel fixer to judge the half way position for the centre bar and half way again for the remaining bars to be installed between the centre and the first bars tied to each alternate 800 mm apart leg location of the Integral bar chair.

When the welding process is completed the bar with the attached wire chairs is removed from the assembly table and jig fixture and the process is repeated. The integrated bar chair assemblies can be produced in any length, however the preferred ones are standard lengths available from the supplier, and can subsequently be cut on site to suit the application. Alternatively these and other bar sizes can be cut to length by the supplier in job specific lots and delivered to the factory for assembly with the appropriate sized bar chairs. The assembled integrated bar chairs are then bundled and delivered to site for the first stage of the reinforcement installation. In this form, they now no longer need site installed bar chairs to support the lower layers of steel, thus saving the cost of these bar chairs as well as the labour to install them, since installing the integrated bar chair assembly is in fact installing a reinforcement bar that is now elevated.

An average 150 m2 suspended slab with all 4 layers of reinforcement steel at 200 mm spacing would need approx. 150/0.8=187 meters of bar chair assembly in the floor. In the same floor design above there is approximately a total of 3000 linear meters of N12 bars, so that the pre made bar chair assemblies in this case represents about 6% of the total bar required in the design and the bar chair assembly is part of the reinforcement requirement, anyway.

When the bar chair assemblies are delivered to site, they are laid out on the formwork (or ground with plates as the case may be) at 800 mm centres after considering the start point and the required slab edge concrete cover. The 4 intermediate bars of the first layer are laid out on the formwork parallel to the bar chair assembly and the first cross bar of the second layer is fixed in place connecting all the front legs of the first line of bar chairs across the 800 spacing direction. All the ends of the intermediate bars are tied to the underside of this bar and the process is repeated at every 750 ctrs or next closest leg along the bar chair assembly.

The last part of the process is installing the two intermediate cross bars at 250 mm centres infilling equidistantly between each corresponding tied bar chair leg along the assembly. The steel lap junctions are tied together every second one, until all the bottom two layer are completed.

The third lay of steel begins by placing two bars on top of the bottom mesh at 250 spacings (between the 750 spacing chairs at right angles to the line of the bar chair assembly direction) and then installing the bar on top of the chair. A top bar is installed along the side of the top of the bar placed on top of the chair, and in line with the edge of the chair, so that the two bars can be tied to the top of the chair. This is repeated for all the adjacent lines of bar chairs until a grid of 750×800 bars is completed. The two intermediate bars resting on top of the second layer of steel are pulled up and tied to the top steel and that process is completed when the visible grid is 250×800. The remaining top steel of 4 bars are placed at 200 mm ctrs across the top and tied to the bar underneath at every second space, until the finish grid is 250 mm×200 mm. During the installation process the steel fixer is predominantly standing on the layer being tied or in an unimpeded way on the layer below.

The integrated bar chair assembly can be manufactured by simply making an assembly jig in which chairs and bars can be assembled. Connecting the parts together can be by mig welding or by clamping together and electrically welding the parts together, similar to the process of welded mesh manufacture. This can be done in line with the bar straightening and docking machine in a continuous process with more capital investment. The down side of the inline production system is the endless variety of sizes and depths of the chairs and spacing of the chairs to assist with the installation of the reinforcement steel on site.

Another aspect of the present invention is to produce an integrated bar chair assembly in a high volume production manufacturing system by using a moulded plastic chair designed specifically for that purpose. The integrated bar chair assembly as described in the earlier provisional application, removes the need to chair on site, it locates and positions the lower layer of steel as well as sets the upper two steel layers to achieve the correct concrete coverage on the top as well as on the bottom steel in one process and also provide a device of the bar that allows easier location of intermediate reinforcement bars during the installation process. The two elements of this invention that can easily be manufactured in a high volume factory is the spacing of the bottom bar above the formwork for concrete cover and the spacing of the chair along the bar. The largest variable which is the setting of the top steel height then becomes the attachment to the bottom component fitted to the bar when it is on site.

So a further aspect of the present invention is to provide a two part plastic bar chair component, the bottom half which is a standard component for all reinforcement except for its fit to a bar diameter, that can be clamped, bonded or otherwise fixed to a reinforcement bar during its production, which sets the height of the bar above the formwork to achieve a minimum bottom steel concrete cover, and spaced along the beam to achieve the required chair support and to assist in the location of intermediate bars, and can suit high volume production in line with bar production, and a second part of the chair component, that comes in a range of sizes, which snaps on or otherwise joins onto the top of the bottom component on site which sets the height of the second layers of steel. These components may be made from other suitable material, or materials that may be used in extreme environments. The bottom component is designed with a clamping action that would suit pressing onto the reinforcement bar, and the top part have a device that would enable the top chair component to sit into it or snap onto it, locking it into position after or before the bottom layers of steel are installed.

The integrated bar chair invention can be incorporated into the erection of reinforcement bars within concrete beams, in isolation or integrated within concrete slabs. Instead of fixing either of the proposed chair arrangements as previously described onto the reinforcement bars, they can be direct fixed to the stirrups and spaced apart sufficient to support the longitudinal bars that will be installed upon them. The purpose of the stirrup is to provide shear reinforcement for the beam, and in this arrangement the stirrups are formed in a U section with small returns, which are turned into a hook when the reinforcement bar is installed in the beam. In another aspect of the current invention the wire chairs are fixed to the stirrup bars to support the lower steel reinforcement and to allow the upper level steel reinforcement to be installed on top of the prefixed bar which rests on the top of the bar chair support. These are arranged along the beams at specified distances and intermediate stirrups are interspaced accordingly and tied into position. The process is repeated until all the stirrups are installed and then with a simple hand tool, the ends of the stirrup are hooked over the top side reinforcement steel. The benefit to the steel fixer is that he can install the bars in a pre-chaired stirrup from the top instead of threading the conventional closed stirrup over the bars and tying them together and chairing the finished cage afterwards.

Another aspect of the invention is to provide a bar chair that doesn't collapse under load, can be used to locate the intermediate bars, provide two layer support at the one time while reducing the number of bar chairs by 50%, and either reduce the bar chair installation time altogether or at least reduce it significantly, and provide inbuilt management systems to assist with the setting out of the reinforcement steel coupled with a more sophisticated manufacturing system that makes use of a two part bar chair system that is installed by a machine in a factory and the other component installed by steel fixers on site, which will reduce time and materials required in the steel fixing installation process.

Preferred embodiments of the present invention provide an improved method of installing reinforcement mesh and reinforcing bar in concrete slabs on ground or suspended and addresses at least the issues discussed in the background. In particular, the preferred embodiment aims to provide one or more of the following features:

- Provide a bar chair assembly that reduces set out time.
- Provide a bar chair assembly that provides support for the lower and upper reinforcement bar and or mesh, reducing the number of bar chairs by 50% and thus saving material costs.
- Provide a bar chair assembly support means that adds to the reinforcement of the slab.
- Provide a bar chair assembly support means that doesn't collapse under construction loading.
- Provide a bar chair assembly support means that assists in managing the reinforcement bar spacing.
- Provide a means of chairing reinforcement that requires less labour to install.
- Provide a system of placing and tying reinforcement bar that reduces labour in the installation.
- Provide a system of placing and tying reinforcement bar and mesh that reduces the cost of a concrete slab.
- Provide a bar chair assembly that reduces set out time.
- Provide a bar chair assembly that provides support for the lower and upper reinforcement bar and or mesh at the same time, reducing the number of bar chairs by 50% and thus saving material costs.
- Provide a bar chair assembly support means that adds to the reinforcement of the slab.
- Provide a bar chair assembly support means that doesn't collapse under construction loading.
- Provide a bar chair assembly support means that assists in managing the reinforcement bar spacing.
- Provide a means of chairing reinforcement without the need for site labour.
- Provide a bar chair that has improved resistance against corrosion.
- Provide an alternate bar chair design that can maximise uniformity of chair to bar attachment during manufacturing of the integrated bar chair.
- Provide a system of placing and tying reinforcement bar that reduces labour in the installation.
- Provide a system of placing and tying reinforcement bar and mesh that reduces the cost of a concrete slab.
- Provide a manufacturing process that can fix a chair on a reinforcement bar which also acts as a location device for on site steel placement
- Provide an alternative design for concrete beams by prefixing a bar chair to a stirrup in lieu of a reinforcement bar.

Whilst preferred embodiments of the present invention have been described, it will be apparent to skilled persons that modifications can be made to the embodiments described.

For example, the wire bar chair can be have three legs only with only one of the legs attached to the reinforcement bar. front portion.

We claim:

1. An assembly for supporting a concrete slab, said assembly comprising:

an elongate reinforcement bar; and a plurality of bar chairs attached to the reinforcement bar at spaced locations so as to support a load of a concrete slab, each bar chair having an upper seat, a lower end, and spaced legs extending downwardly from the upper seat toward the lower end, wherein said spaced legs of each bar chair are comprised of two sets of opposed legs oriented at 90 degrees to each other, wherein one set of opposed legs of each bar chair is attached to the reinforcement bar at a position between a respective upper seat and a respective lower end of each leg of said one set of opposed legs wherein each leg of said one set of opposed legs is attached to an opposite side of the reinforcement bar.

2. The assembly of claim 1, wherein each lower ends of each bar chair having a coating selected from one of a group consisting of: plastic coating and galvanizing material.

3. The assembly of claim 1, wherein said two sets of opposed legs are comprised of a first set of opposed legs having a first distance between the opposed legs of said first set of opposed legs, and a second set of opposed legs having a second distance between the opposed legs of said second set of opposed legs, said first distance being larger than said second distance, and wherein the reinforcement bar is attached to the first set of opposed legs.

4. The assembly of claim 1, wherein each upper seat is concave.

5. The assembly of claim 1, further comprising:

another reinforcement bar placed in the at least one upper seat and orthogonal to the reinforcement bar.

6. The assembly of claim 1, wherein each set of said two sets of opposed legs is comprised of an inverted U-shaped wire.

* * * * *